United States Patent [19]

Stoll

[11] 4,326,658

[45] Apr. 27, 1982

[54] BAND-FEEDING DEVICE

[76] Inventor: Kurt Stoll, Lenzhalde 72, 7300 Esslingen a.N., Fed. Rep. of Germany

[21] Appl. No.: 96,277

[22] Filed: Nov. 21, 1979

[30] Foreign Application Priority Data

Nov. 30, 1978 [DE] Fed. Rep. of Germany ..... 2851746

[51] Int. Cl.[3] ..... B65H 17/26

[52] U.S. Cl. ..... 226/141; 226/150

[58] Field of Search ..... 226/141, 150, 139, 67; 101/196–198

[56] References Cited

U.S. PATENT DOCUMENTS

| | | | |
|---|---|---|---|
| 3,485,430 | 12/1969 | Scribner | 226/141 |
| 3,537,392 | 11/1970 | Ikuss | 101/198 |
| 4,059,212 | 11/1977 | Ledgerwood | 226/141 |
| 4,223,821 | 9/1980 | McCall | 226/101 |

FOREIGN PATENT DOCUMENTS

| | | |
|---|---|---|
| 1152588 | 8/1963 | Fed. Rep. of Germany . |
| 1602547 | 8/1970 | Fed. Rep. of Germany . |
| 1810709 | 6/1970 | Fed. Rep. of Germany . |
| 2329897 | 1/1975 | Fed. Rep. of Germany . |

*Primary Examiner*—Leonard D. Christian
*Attorney, Agent, or Firm*—Blanchard, Flynn, Thiel, Boutell & Tanis

[57] ABSTRACT

A device for feeding an elongated band or strip of material in a step-by-step manner toward a material processing station, such as a punch or the like. The device includes a housing having a chamber therein in which is located a reciprocal piston. The piston rod connected to the piston extends out through an opening in the housing and is at the free end thereof connected to a clamping jaw. An adjustable stop is provided in the chamber for controlling the length of the stroke of the piston. Structure for facilitating a deceleration of the piston as it approaches its limits of movements are provided at opposite ends of the chamber. Fluid connections are provided in one of the guide rods supporting the clamping jaw and facilitate a fluid supply to the clamping jaw without the use of external hoses. The control valve structure for the feeding device is mounted on a rotatable valve block structure to facilitate a reversal of the sequence of the feeding stroke.

17 Claims, 8 Drawing Figures

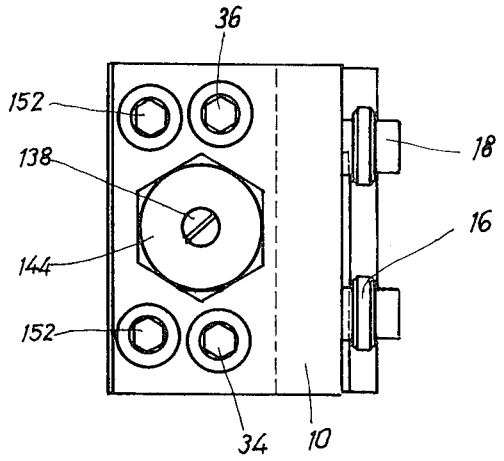
Fig. 6
Fig. 7a
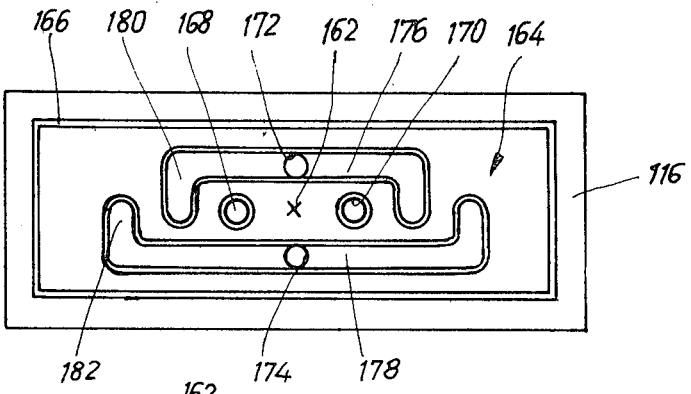
Fig. 7b
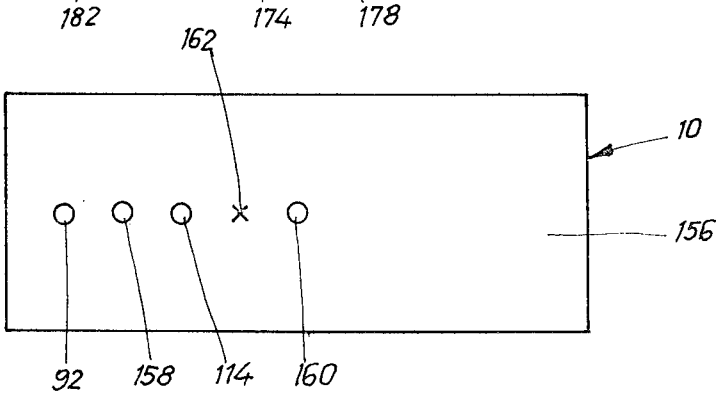

BAND-FEEDING DEVICE

FIELD OF THE INVENTION

The invention relates to a band- or strip-feeding device and, more particularly, to a device facilitating the advancement of an elongated band or strip by effecting a clamping of a reciprocal claw to the band or strip at the time the claw is moved between its limit positions.

BACKGROUND OF THE INVENTION

Such band-feeding devices are, for example, used to guide an elongated band or strip of sheet metal intermittently to a punch. In the known band-feeding devices, the pressure load of the movable clamping claw is carried through a flexible hose. This has the disadvantage in situations where the installation volume of the band-feeding device is enlarged; furthermore moving machine parts or persons can get caught on the flexible hose sections. Finally, a rupturing of the hose connections are always a risk for the operating safety.

Therefore, the present invention provides a further development of the known band-feeding device in such a manner that the hose connection to the movable clamping claw can be omitted.

Starting out from the known band-feeding device, this purpose is inventively attained by providing one of the guide rods for one of the clamping claws with a pressure medium channel therein, which guide rod extends with its free end section sealed against the flow of fluid into a blind hole of a further clamping claw, to which hole the clamping structure of the further clamping claw is in fluid connection.

The inventive band-feeding device has very compact dimensions and smooth limiting surfaces for effecting an adjustment of the stroke. It can therefore also be installed well near moving machine parts and under narrow space conditions. The pressure medium supply for the moving clamping claw is protected against outside influences. Also the axial dimensions of the band-feeding device can be kept small, since no consideration needs to be given to small curvature radii of hoses.

By connecting the valve block directly on the housing, which valve block controls both the tensioning movements and also the relative movement between the clamping claws, the hose connections can be eliminated.

A further development of the invention includes a provision wherein the stroke of the relative movement between the two clamping claws can be adjusted in a simple manner.

This adjustment occurs preferably by using a threaded member. In this case, one can adjust from an external source and with great precision the stroke by counting the rotations of a shank portion of a stop and by reading the angle position of the shank, in practice easily by using a fine thread with an exactness of better than 0.05 mm.

A further improvement over known band-feeding devices is the provision that the movable clamping claw smoothly decelerates as it approaches its end positions and also smoothly accelerates again away therefrom. With this it is assured that an undesired slip does not occur between the jaws of the clamping claw and the band to be conveyed.

The end damping position can be adjusted in order to allow for a different size stroke, different conveying speeds through a suitable change of the pressure medium load of the working cylinder which creates the relative movement of the clamping claws and different friction conditions.

BRIEF DESCRIPTION OF THE DRAWINGS

The invention will be discussed in more detail with reference to one exemplary embodiment and with reference to the drawings, in which:

FIG. 6 is a plan view of the front end of the band-feeding device, which front end is on the left side of FIGS. 1, 2 and 3; and FIGS. 7*a* and 7*b* are schematic views of the oppositely positioned side surfaces of the housing of the stationary clamping claw and of a valve block which is mounted on the latter.

DETAILED DESCRIPTION

Figure 1:
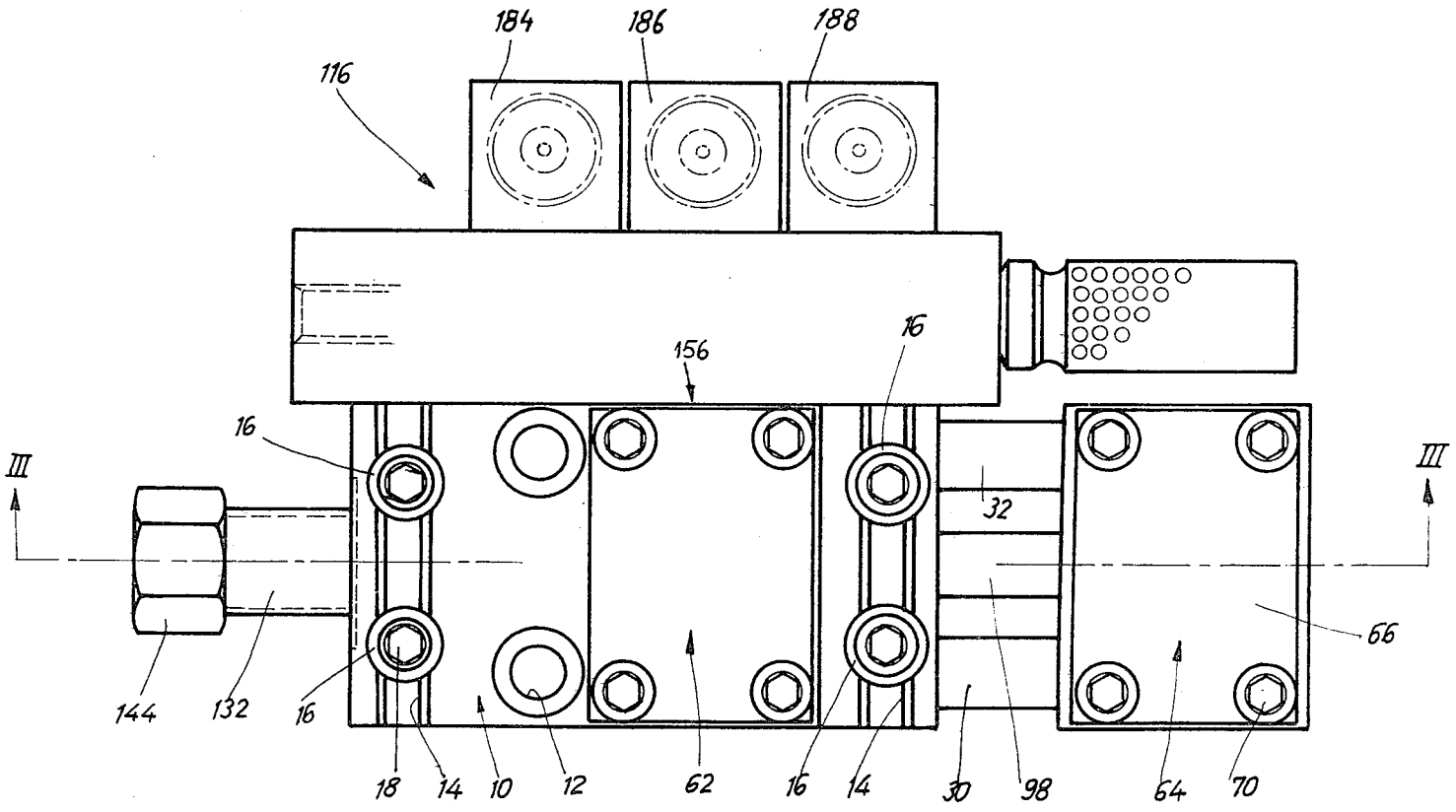
FIG. 1 is a top view of a band- or strip-feeding device with a fixed first clamping claw and a movable second clamping claw, which is shown in a fully extended condition.
Figure 5:
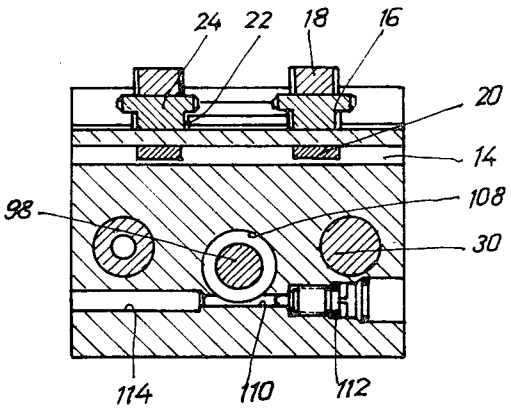
FIG. 5 is a transverse cross-sectional view of the band-feeding device according to FIG. 1 taken along the line V—V of FIG. 3.
Figure 4:
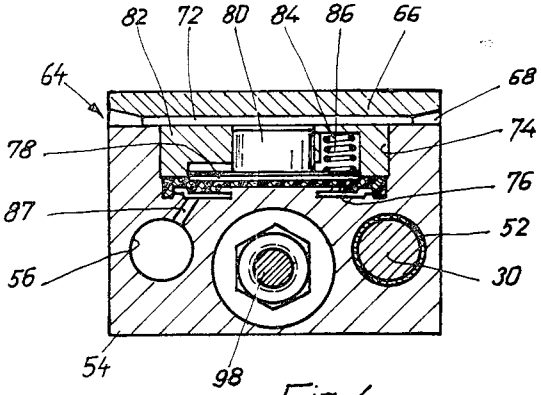
FIG. 4 is a transverse cross-sectional view of the band-feeding device according to FIG. 1 taken along the line IV—IV of FIG. 3.

FIG. 1 illustrates a band- or strip-feeding device having a housing 10, which can be connected to the frame of a punch by bolts which are not shown and which are received through perforations 12. As FIG. 5 illustrates, guide rollers 16 are rotatably positioned by means of screws 18 in transversely extending grooves 14 on the upper side of the housing, through which screws clamping members 20 are fixedly held on back tapers of the grooves 14. The guide rollers 16 have running surfaces 22 each of which cooperates with the edge surfaces of the band and flanges 24 each of which grips over the band edges.

Figure 3:
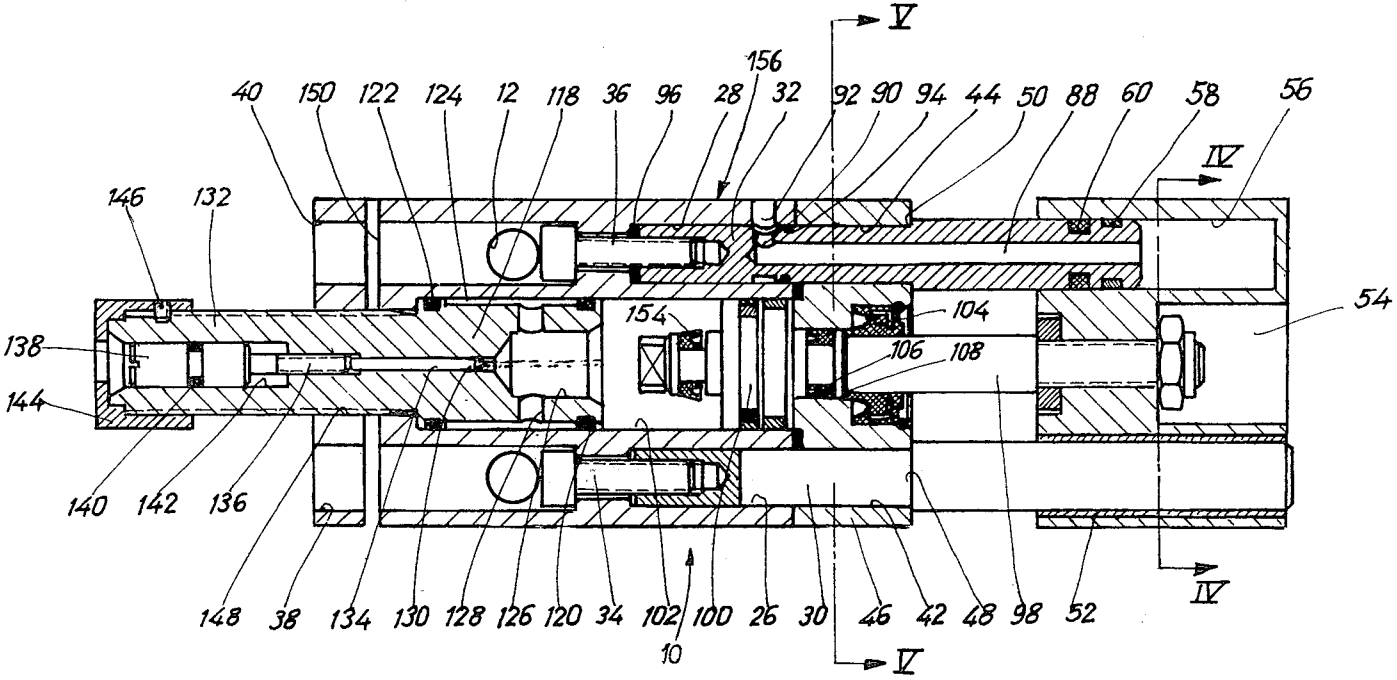
FIG. 3 is an axial cross-sectional view of the band-feeding device according to FIG. 1 taken along the line III—III of FIG. 1.

As can best be seen from FIG. 3, the housing 10 has two axially extending openings 26 and 28, which guide rods 30 and 32 are secured by bolts 36 and 38. The bolts 36 and 38 are introduced and accessible through aligned openings 38 and 40 in the housing.

The guide rods 30 and 32 also extend through openings 42 and 44 in an end plate 46 on the housing 10, on which they are supported through shoulders 48 and 50.

The cantilevered end of the guide rod 30 extends through a journal-bearing bushing 52, which in turn is secured in a movable housing 54.

The cantilevered end of the second guide rod 32 extends into a blind hole 56 in the housing 54 and carries at its end section a slide-bearing ring 58 and a gasket 60 which lies therebehind.

The housing 10 and the housing 54 which is movable on the guide rods 30 and 32 each carry a clamping claw which can be activated through a fluid pressure load for effecting a securing of the band, which are identified as a whole in FIG. 1 by the reference numerals 62 and 64. The clamping claws 62 and 64 have the same design, therefore, with reference to FIGS. 1 and 5, only the clamping claw 64 will be described in more detail now.

The clamping claw 64 has a reaction plate 66, which rests with feet 68 on the upper side of the housing 54 and is fixedly connected to the latter by means of screws 70. Thus a rectangular passage for the band which is to be intermittently fed remains between the upper side of the housing 54 and the underside of the reaction plate 66. A cylindrical, offset recess 74 is provided in the upper side of the housing 54, into which recess are inserted a diaphragm 76, a pressure plate 78 and a cylindrical pressure member 80 which is moved with said pressure plate and a guide insert 82 for the last-mentioned two parts. The guide insert 82 is fixedly connected to the housing 54 by screws (not shown). A spring chamber 84 having a helical spring 86 therein is provided in the guide insert 82 on a side of the pressure member 80 remote from the housing 54, through which spring the pressure member 80 is initially tensioned in a retracted position toward the housing 54.

The underside of the diaphragm 76 is connected through a channel 87 to the opening 56, which opening 56 in turn is connected to an axially extending channel 88 in the guide rod 32, which channel terminates adjacent the front or left (FIG. 3) end of the guide rod 32. The channel 88 has a radially extending channel section 90, which is axially aligned with and connected to a connecting opening 92 in the housing 10. The exterior surface of the guide rod 32 is sealed off from the opening 44 by an O-ring seal 94 and its front end surface is sealed off against the bottom of the opening 44 by an axially compressed gasket 96.

The clamping claw 64 operates as follows:

If the connecting opening 92 is supplied with a pressurized fluid, the pressure plate 78 and the pressure member 80 are moved upwardly against the force of the helical spring 86. The free front surface of the pressure member 80 will rest on the underside of the band or strip to be conveyed and same is fixedly clamped in between the pressure member 80 and the reaction plate 66. The band is then moved to the right together with the housing 54, wherein the pressure load is then maintained through the blind hole 56 and the channel 88. Upon an exhausting of the pressure to the connecting opening 92, the pressure plate 78 and the pressure member 80 are urged downwardly by the helical spring 86, so that the band to be conveyed again lies with play between the upper side of the housing 54 and the underside of the reaction plate 66. A movement of the housing 54 then no longer leads to a corresponding movement of the band.

The clamping claw 62 operates in the same manner, only its pressure loading for the intermittent conveying of the band occurs by a push-pull effect with respect to the pressure load of the clamping claw 64, as will be described in more detail below.

To move the housing 54 on the guide rods 30 and 32, a double-acting pneumatic working cylinder is provided, the piston rod 98 of which is fixedly secured with its end to the housing 54 and the piston 100 of which travels in a cylindrical opening 102 in the housing 10.

A gasket 104 for sealing off the piston rod 98 is secured in the end plate 46. An end section of the piston 100, which section is located on the right side thereof, carries a gasket 106, which, when the piston 100 approaches its right end position, enters a bore section 108 of the passage for the piston rod 98, which bore section forms a damping chamber. As one can best see from FIG. 5, the bore section 108 is connected through a transversely extending channel 110 which intersects said bore section and an adjustable throttle member 112 to the atmosphere. A channel section 114 which is enlarged and is on the opposite side of the bore section 108 from the throttle member 112 is connected to a valve block which in FIG. 1 is identified as a whole by the reference numeral 116 and terminates in the same side surface of the housing 10 as does the connecting opening 92 and the connecting opening for the fluid pressure load for the clamping claw 62, which connecting opening is not shown in FIGS. 1 to 5.

To the left side of the piston 100 there is movable in the cylindrical opening 102 an elongated adjustably movable and selectively positionable stop 118 which has at each axial end thereof gaskets 120 and 122. An annular recess 124 extends around the periphery of the stop between the gaskets 120 and 124. The annular space which is defined by the cylindrical opening 102 and the recess 124 is connected to a channel (not shown), which starts out from one point of the cylindrical opening 102, which in the illustrated position of the adjustable stop 118 corresponds to the maximum stroke of the piston 100, which lies directly to the left of the gasket 120, and terminates in the side surface of the housing 10 which abuts the valve block 116.

A damping chamber 126 opens outwardly to the right of the adjustable stop 118, which chamber 126 is connected to the annular space or recess 124 through radial channels 128. Furthermore an axial extending channel 130 extends from the damping chamber 126 in a shank portion 132 of the adjustable stop 118, which shank portion has an external thread thereon. A needle-like throttle member 134 is arranged in the channel 130, which member 134 can be adjusted by means of a threaded section 136. An enlarged head 138 on the throttle member 134 carries a gasket 140 thereon and slidingly seals the head against the internal wall surface of an enlarged opening 142 of the channel 130.

A cap nut 144 is fixedly secured against rotation on the outer end of the threaded section of the shank portion 132 by a screw 146. By rotating the nut 144, the shank portion 132 can be adjusted lengthwise in a tapped hole 148 in the housing 10. Below the nut 144 which is oriented on the left side in FIG. 1, the housing 10 has a downwardly open slot 150 (compare in particular FIG. 2), which slot divides the tapped hole 148 into two sections, which sections can be tilted relative to one another by a tightening of the screws 152 (compare FIG. 6). In this manner, the shank portion 132 and thus the adjustable stop 118 are locked in a one-time adjusted axial position.

The piston 100 carries on its left side a gasket member 154, which can enter into the damping chamber 126 with the occurrence of a leftward movement thereof.

FIG. 7*b* schematically illustrates a plan view of the side surface 156 of the housing 10, which side surface 156 is the top surface in FIG. 3. The top surface 156 has the connecting opening 92 for the clamping claw 64, a connecting opening 158 for the clamping claw 62 and the end of a channel 114 and the end of a further channel 160, which extends to the annular spacing which is defined by the cylinder opening 120 and the recess 124. An x 162 indicates the position of an axis which extends perpendicularly with respect to the drawing plane, and about which the valve block 116 can be rotated at 180°, in order to reverse the feed direction of the band- or strip-feeding device.

As is illustrated in FIG. 7*a*, a sealing plate 164 having a sealing rib 166 which extends along the edge is inserted in the side surface of the valve block 116. An opening 168 which is oriented on the left side of the x 162 and an opening 170 which is oriented on the right side of the x 162 are in alignment with corresponding channels of the valve block 116 and when the valve block 116 is mounted on the housing 10, additionally with each one of the channels 114 and 160, respectively. Channels 172 and 174 of the valve block 116 communicate with elongated slots 176 and 178 in the sealing plate 164, which has at its ends inwardly extending end sections 180 and 182. The distance of the end sections 180 and 182 from the x 162 corresponds with the distance of the connecting opening 158 and 92, respectively, from the x 162. In this manner, at both orientations of the valve block 116, the channel 172 is always in fluid connection with the connecting opening 158, the channel 174 is always in fluid connection with the connecting opening 92. The opening 168, however, is one time connected to the channel 114, the other time to the channel 160, correspondingly the opening 170 one time connected to the channel 160 and the other time to the channel 114.

By a simple changeover of the valve block 116, one thus obtains a reversal of the external control and a reversal of the sequence of movement of the band-feeding device, since the phase position of the control of the double-acting working cylinder is rotated at 180°; however, the control of the clamping claws is maintained. It is to be understood that one can just as well maintain the phase position of the control of the working cylinder by providing suitable slots in the sealing plate 164 independent from the installation position of the valve block 116 and can provide the connecting opening for the clamping claws symmetrically with respect to the reversing axis.

As can be seen from FIG. 1, the valve block 116 carries three valves 184, 186 and 188. The valve 184 controls the pressure medium supply for the double-acting working cylinder and thus the movement of the housing 54 and the clamping claw 64. The valve 188 takes care of the push-pull pressure load of the two clamping claws 62 and 64, as is required for the intermittent conveying of the band. The middle valve 186 permits additionally to set both clamping claws 62 and 64 simultaneously in an unclamping condition, so that the band can be moved freely through both clamping claws. This is of an advantage during a pulling in of the band, on the one hand, and permits moreover the use of bands which have indexing holes, which can then be finely positioned after the feed has been carried out through positioning pins which are received in the holes, for which purpose both clamping claws are then opened.

Figure 2:
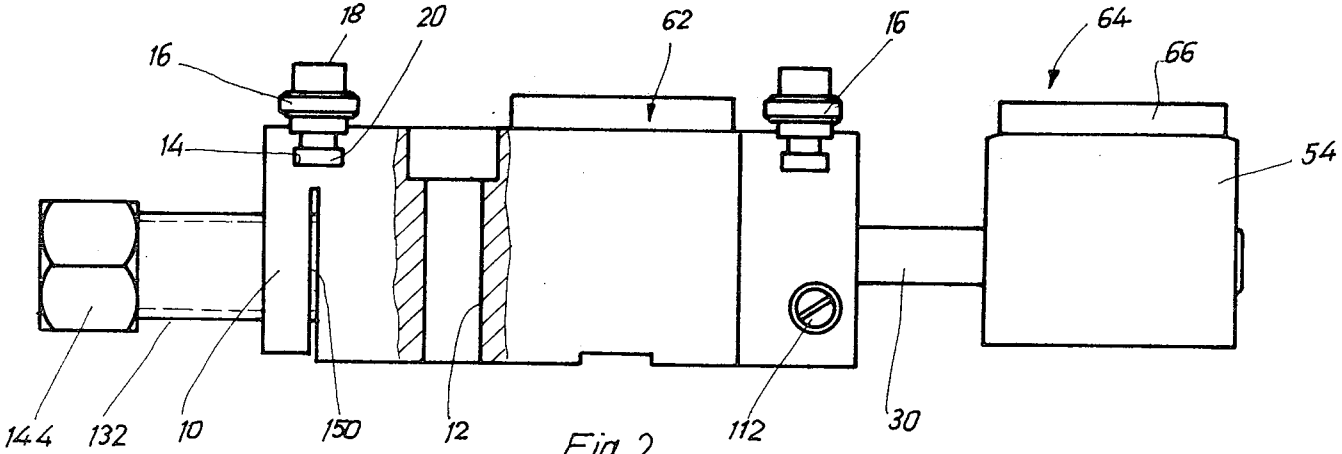
FIG. 2 is a lateral view of the band-feeding device according to FIG. 1.

During the intermittent feed of a band, the above-described band-feeding device operates as follows:

At the start of the cycle, the clamping claw 64 is in the position which is shown in FIGS. 1, 2 and 3. The connecting opening 92 is now relieved of the pressure and the working chamber of the double-acting working cylinder, which is on the right of the piston 100 in the drawing is loaded with pressure through the channel section 114. The clamping claw 64 moves now to the left, without engaging the band to be conveyed. After the gasket 154 enters the damping chamber 126, the piston 100 stops. The connecting opening 92 is now loaded with pressure and the pressure load on the connecting opening 158 is interrupted. With this the clamping claw 64 fixedly grabs the band to be conveyed, while the clamping claw 62 releases the band. During the following pressure load on the channel 160, the piston 100 and the clamping claw 64 are the moved to the right, whereby the band to be conveyed is pulled along. The gasket 106 finally enters the bore section 108, which causes the piston 100 to be slowed down and prevents same from hitting the end plate 46. With this a feed cycle is terminated.

Although a particular preferred embodiment of the invention has been disclosed in detail for illustrative purposes, it will be recognized that variations or modifications of the disclosed apparatus, including the rearrangement of parts, lie within the scope of the present invention.

The embodiments of the invention in which an exclusive property or privilege is claimed are defined as follows:

1. In a band-feeding device comprising:

a stationary first pressure medium operated clamping claw for selectively securing a band of material which is to be moved step by step;

two guide members secured on the first clamping claw;

a second pressure medium operated clamping claw movable on the guide members for selectively securing a different section of the band of material, said first and second clamping claws each having a servomotor and a pressure medium connection for operating same;

a working cylinder having relatively movable parts each connected to a respective one of the clamping claws; and a longitudinally changeable pressure medium connection through which said servomotor of the second clamping claw is connected with said pressure medium connection of the first clamping claw, said longitudinally changeable pressure connection having a plunge piston provided with a through-going pressure medium channel, said plunge piston being carried by one said clamping claw and running in a blind hole of the other said clamping claw and being sealed against leakage of pressure medium, the improvement comprised in that said guide members are guide rods and the servomotor of the second clamping claw is a conventional single-acting servomotor, both said guide rods being carried by the stationary first clamping claw, one said guide rod forming said plunge piston provided with the through-going pressure medium channel, said one guide rod running with its free end section sealed against leakage of pressure medium in a blind hole in the second clamping claw, the other guide rod being longer in axial dimension than said one guide rod, and such that said other guide rod always extends entirely through a through hole in the second clamping claw.

2. The device according to claim 1, wherein said one guide rod containing the through-going pressure medium channel is inserted into a hole of the first clamping claw and sealed against pressure medium leakage, the first clamping claw having a housing containing connecting openings, the end of the through-going pressure medium channel associated with the first clamping claw being connected to one of said connecting openings in said housing of the first clamping claw.

3. The device according to claim 2, wherein the pressure medium channel has at its said end a radial channel section terminating in a side surface of the housing of the first clamping claw to form said one connecting opening, said side surface having further connecting openings leading to the working cylinder and the first clamping claw, and a common valve block for controlling the clamping movements of the clamping claws and the relative movements between the clamping claws and being located on said side surface.

4. The device according to claim 3, wherein the connecting openings for the working cylinder, upon reversal of the position of the valve block about an axis perpendicular to the side surface, are in alternate alignment, the valve block having channels through which the connecting openings for the clamping claws are loaded with the same pressure in both mounting positions of the valve block.

5. The device according to claim 4, wherein the valve block has a valve which controls the push-pull pressure loading of the clamping claws, and a further valve by which both clamping claws can be placed simultaneously into a position which releases the band of material.

6. The device according to claim 1, wherein said through hole of the second clamping claw is provided with a slide bearing sleeve.

7. The device according to claim 1, wherein said one guide rod containing the pressure medium channel has at its free end an elastomeric sealing ring and a slide bearing ring which is hard compared with said sealing ring, said rings axially lying one behind the other.

8. The device according to claim 1, wherein the working cylinder has one end wall formed by an adjustable stop which is movable in the cylinder and is sealed off against fluid flow therepast.

9. The device according to claim 8, wherein the adjustable stop has a shank portion which is provided with an external thread, and which extends through a tapped hole in the housing of the first clamping claw.

10. The device according to claim 9, wherein the working cylinder contains a piston, and including a damping chamber constructed in the adjustable stop, into which damping chamber can be introduced an end section of the piston of the working cylinder, which end section has a reduced diameter.

11. The device according to claim 10, including an adjustable throttle opening through which the damping chamber is connected to the atmosphere.

12. The device according to claim 11, wherein the shank portion of the adjustable stop has an axial opening, the throttle opening including a needle-like throttle member, which is movable in the axial opening of the shank portion of the adjustable stop.

13. The device according to claim 10, wherein the adjustable stop has two axially spaced annular gaskets at the ends thereof and a recess which lies therebetween, wherein the recess communicates through at least one radial opening with the damping chamber, an annulus being defined by the recess and the cylinder wall, said annulus being connected to one of the connecting openings for the working cylinder.

14. The device according to claim 10, wherein the working cylinder has a stationary end wall constructed with a second damping chamber therein, into which a second end section of the piston extends, said second end section of said piston having a reduced diameter and being sealed off against fluid flow therepast.

15. The device according to claim 14, including a second adjustable throttle connecting the second damping chamber to the atmosphere.

16. The device according to claim 15, wherein the second adjustable throttle and a pressure medium connection for the working cylinder communicate at the same axial point into the second damping chamber.

17. The device according to claim 1, wherein the guide rod having the through-going pressure medium channel to the second clamping claw also has at its free end, axially lying one behind the other, an elastomeric gasket and a slide-bearing ring which is hard compared with said gasket.

* * * * *